US010913560B2

(12) United States Patent
Ludwig

(10) Patent No.: US 10,913,560 B2
(45) Date of Patent: Feb. 9, 2021

(54) MULTIPACKAGE APPLICATOR DEVICE

(71) Applicant: Christopher J. Ludwig, Buffalo Grove, IL (US)

(72) Inventor: Christopher J. Ludwig, Buffalo Grove, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 635 days.

(21) Appl. No.: 14/591,723

(22) Filed: Jan. 7, 2015

(65) Prior Publication Data

US 2015/0197357 A1 Jul. 16, 2015

Related U.S. Application Data

(60) Provisional application No. 61/938,574, filed on Feb. 11, 2014, provisional application No. 61/931,994, filed on Jan. 27, 2014, provisional application No. 61/928,288, filed on Jan. 16, 2014.

(51) Int. Cl.

| | |
|---|---|
| ***B65B 27/04*** | (2006.01) |
| ***B65B 17/02*** | (2006.01) |
| ***B65B 41/12*** | (2006.01) |
| ***B65B 67/00*** | (2006.01) |
| ***B65B 21/00*** | (2006.01) |

(52) U.S. Cl.

CPC ..... *B65B 27/04* (2013.01); *B65B 17/02* (2013.01); *B65B 17/025* (2013.01); *B65B 21/00* (2013.01); *B65B 67/00* (2013.01)

(58) Field of Classification Search

None

See application file for complete search history.

(56) References Cited

U.S. PATENT DOCUMENTS 2,929,181 A * 3/1960 Poupitch ..... B65B 17/025 53/247
2,936,558 A * 5/1960 Glazer ..... B65B 17/025 294/87.2
2,995,272 A * 8/1961 Larson ..... B65D 1/243 206/139
3,137,109 A * 6/1964 Rapata ..... B65D 71/50 53/398
3,303,631 A * 2/1967 Ganz ..... B65B 21/24 53/209
3,404,505 A * 10/1968 Hohl ..... B65B 17/025 206/150
3,474,590 A * 10/1969 Ganz ..... B65B 21/24 271/12
3,565,323 A * 2/1971 Katzenmeyer ..... B65D 71/004 206/562

(Continued)

FOREIGN PATENT DOCUMENTS

GB 2 149 747 A 6/1985

*Primary Examiner* — Hemant Desai
*Assistant Examiner* — Tanzim Imam
(74) *Attorney, Agent, or Firm* — Pauley Erickson & Swanson

(57) ABSTRACT

A device for applying a flexible carrier to a plurality of containers includes a base with a plurality of pockets and an indexing means and a carrier having a series of indexing features that correspond with the indexing means for placement of the carrier relative to the base, wherein a container may be inserted into one of the plurality of pockets of the base for desired alignment within the carrier.

20 Claims, 7 Drawing Sheets

(56) References Cited

U.S. PATENT DOCUMENTS 3,628,305 A 12/1971 Owens et al.
3,859,773 A * 1/1975 Calvert ..... B65B 17/025 53/48.1
3,937,360 A * 2/1976 Doucette ..... B65B 17/025 221/11
3,977,150 A * 8/1976 Culpepper ..... B65B 17/025 221/1
4,079,571 A * 3/1978 Schlueter ..... B65B 17/025 198/418.1
4,213,283 A * 7/1980 Calvert ..... B65B 17/025 53/134.1
4,231,209 A * 11/1980 Walker ..... B65B 17/025 53/314
4,354,334 A * 10/1982 Hara ..... B65B 17/025 53/48.4
4,357,186 A * 11/1982 Calvert ..... B29C 53/40 156/218
4,381,847 A * 5/1983 Bessett ..... B65D 1/36 229/406
4,392,586 A * 7/1983 Hartness ..... B65G 59/106 221/210
4,505,089 A * 3/1985 Osteen ..... B65B 17/025 53/48.5
4,641,483 A * 2/1987 Yamauchi ..... B65B 17/025 53/390
4,649,690 A 3/1987 Schiesz et al.
4,823,959 A * 4/1989 Bixler ..... B65D 71/50 206/159
5,106,297 A * 4/1992 Discko, Jr. ..... A61C 19/005 206/564
5,125,506 A * 6/1992 Galbierz ..... B65B 17/025 206/151
5,263,299 A * 11/1993 Galbierz ..... B65B 17/025 53/390
5,511,755 A * 4/1996 Spykerman ..... B60N 3/108 220/23.8
5,655,654 A * 8/1997 Broskow ..... B65D 71/504 206/150
5,657,863 A * 8/1997 Olsen ..... B65D 71/504 206/150
6,112,497 A * 9/2000 Credle, Jr. ..... G07F 11/10 53/168
6,170,225 B1 * 1/2001 Cervantes ..... B65B 17/025 53/48.4
7,225,927 B2 * 6/2007 Sweeney ..... B65D 1/36 206/564
2005/0133386 A1 * 6/2005 Wong ..... B65D 71/50 206/139
2007/0193889 A1 * 8/2007 Olsen ..... B65D 71/504 206/150
2008/0203204 A1 * 8/2008 Olsen ..... B65D 71/504 242/160.1
2009/0094938 A1 * 4/2009 Biernat ..... B65B 17/025 53/48.4

* cited by examiner

MULTIPACKAGE APPLICATOR DEVICE

CROSS REFERENCE TO RELATED APPLICATIONS

This application claims priority to U.S. Provisional Application Ser. No. 61/928,288, filed on 16 Jan. 2014 and U.S. Provisional Application Ser. No. 61/931,994 filed on 27 Jan. 2014 and U.S. Provisional Application Ser. No. 61/938,574 filed on 11 Feb. 2014. These U.S. Provisional Applications are hereby incorporated by reference herein in their entirety and are made a part hereof, including but not limited to those portions which specifically appear hereinafter.

FIELD OF THE INVENTION

This invention relates to a device for applying a carrier to a plurality of containers such as cans or bottles.

DESCRIPTION OF PRIOR ART

Conventional container carriers are used to unitize a plurality of similarly sized containers, such as cans, bottles, jars and boxes and/or similar containers that require unitization. Flexible plastic ring carriers are one such conventional container carrier. Flexible plastic ring carriers may be used to unitize groups of four, six, eight, twelve or other suitable groups of containers into a convenient multipackage.

Often, merchandisers seek options for consumers to unitize groups of individual containers into desirable custom multipackages. In this way, a consumer can "mix and match" selections of cans, bottles or other containers into a single multipackage. In addition, smaller, low-volume merchandisers, such as liquor stores and convenience stores, and/or bottlers that do not have the necessary volume requirements, floor space or equipment for automated operations may desire a hand-operated device for low-cost, low-volume application of flexible carriers to groups of containers.

Existing equipment for such hand application of flexible carriers to groups of containers include a small, pencil-sized device with an angled end, operated in a manner similar to a shoe horn, for stretching individual apertures of the flexible carriers into engagement with individual containers. This process is time consuming and inconsistent. In addition, table-top fixtures exist whereby a carrier is stretched into position using a large pivoting, cantilevered handle to separate the apertures of the carrier for placement of containers therein. These fixtures are often large, expensive and unwieldy.

SUMMARY OF THE INVENTION

The present invention is directed to a device for applying a flexible carrier to a plurality of containers. The device according to this invention preferably includes a base and a complementary carrier, preferably dispensed from an associated roll of carriers or associated stack of carriers.

In operation, the flexible carrier may be placed on a set of indexing pins or other indexing means and the individual containers may then be inserted into pockets within the base and corresponding apertures within the carrier. The flexible carrier may then be removed from the device resulting in a unitized multipackage suitable for sale, shipping or similar disposition.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
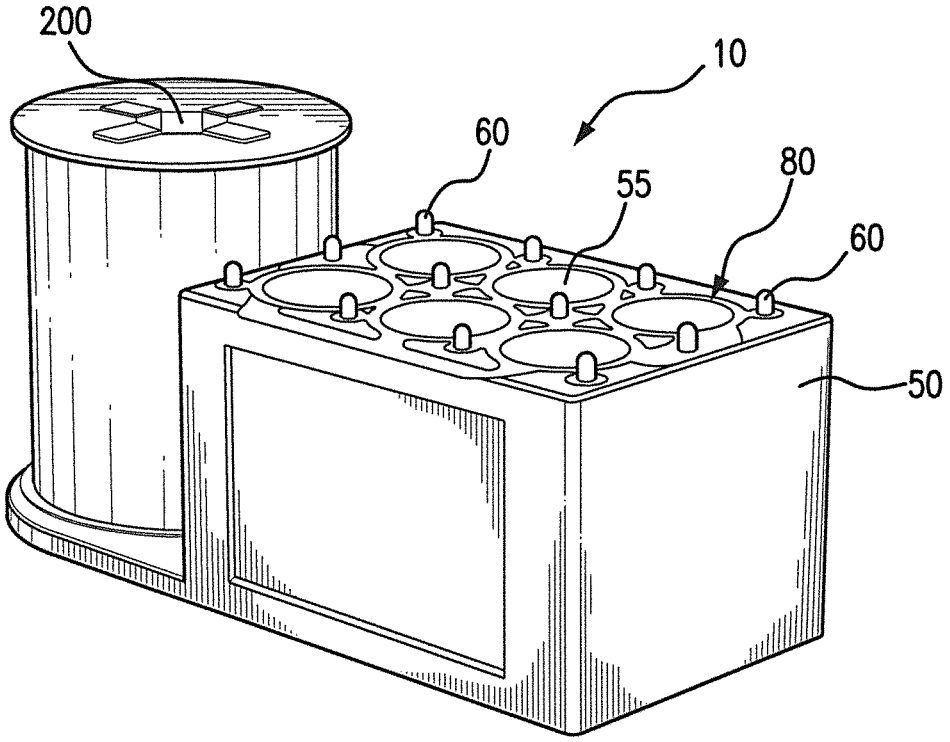
FIG. 1 is a side perspective view of a device according to one preferred embodiment of this invention.

FIGS. 1, 2 and 7-9 show a device 10 for unitizing six containers within a flexible carrier to form a unitized package. Although FIGS. 1, 2, and 7-9 illustrate a multipackage having six or four containers, the illustrations are exemplary, and the invention is not limited to the flexible carriers or device shown. However, the device 10 may be configured and used to unitize eight, twelve or any other desired number of containers and/or flexible carriers. In addition, the device 10 may be configured and used to unitize multiple sets of a desired number of containers simultaneously, such as three sets of two containers or two sets of three containers.

The device 10 as described is used to unitize a plurality of appropriate containers, preferably cans or bottles. However, any other commonly unitized container may be used with the device 10 according to this invention. The containers are preferably like-sized within a single flexible carrier 80.

A multipackage results from application of the flexible carrier 80 to the plurality of containers. Flexible carriers 80 are generally applied to such containers by stretching the flexible carrier 80, specifically the material surrounding individual container apertures 85 around a perimeter of the respective container, and allowing the stretched flexible carrier 80 to recover, thereby providing a tight engagement. The flexible carrier 80 is typically applied to a chime or rib of the container, where this structure exists, or to a main sidewall.

According to a preferred embodiment of the invention, the device 10 for applying the flexible carrier 80 to a plurality of containers 15 includes a base 50 having a series of pockets 55 and a series of indexing pins 60. In addition, the base 50 may include a spindle or similar mount for accommodating a reel or similar assembly of carrier 80 that may be individually dispensed onto the base 50 for application to containers. A reel of carriers 80 may include a generally continuous string of carriers 80 that are separable along perforations.

Figure 2:
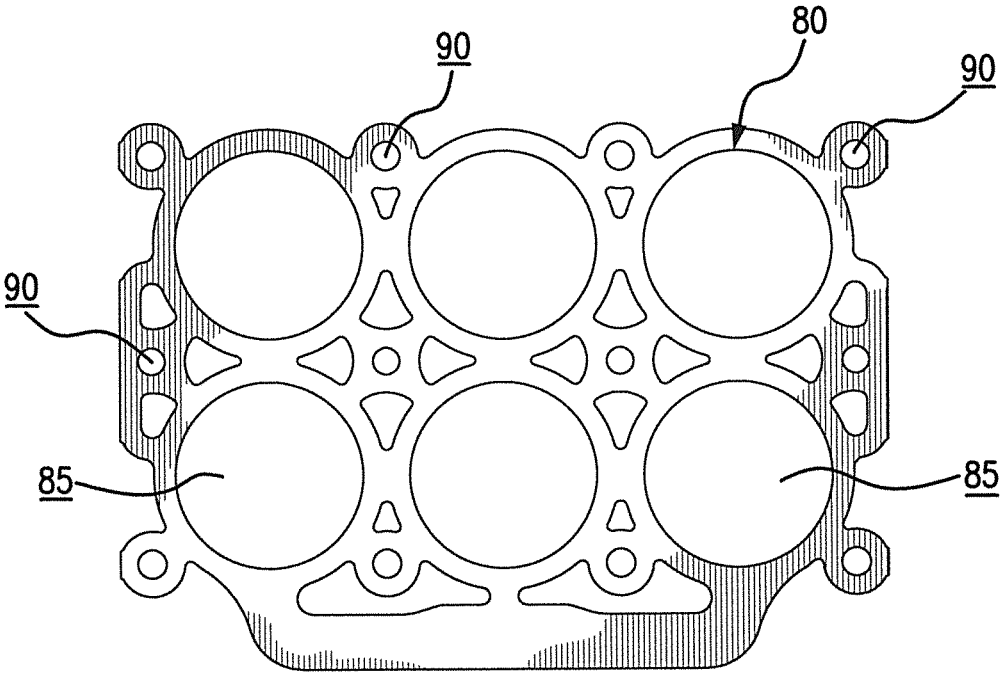
FIG. 2 is a side elevational view of a carrier according to one preferred embodiment of this invention.
Figure 3:
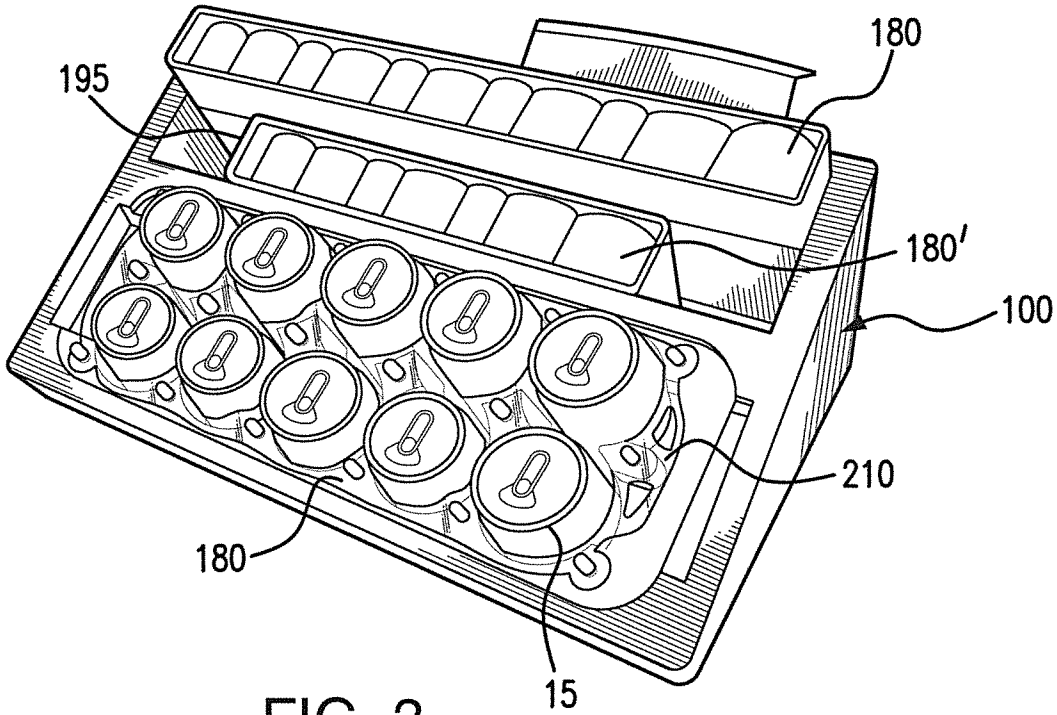
FIG. 3 is a side perspective view of a device according to one preferred embodiment of this invention.
Figure 4:
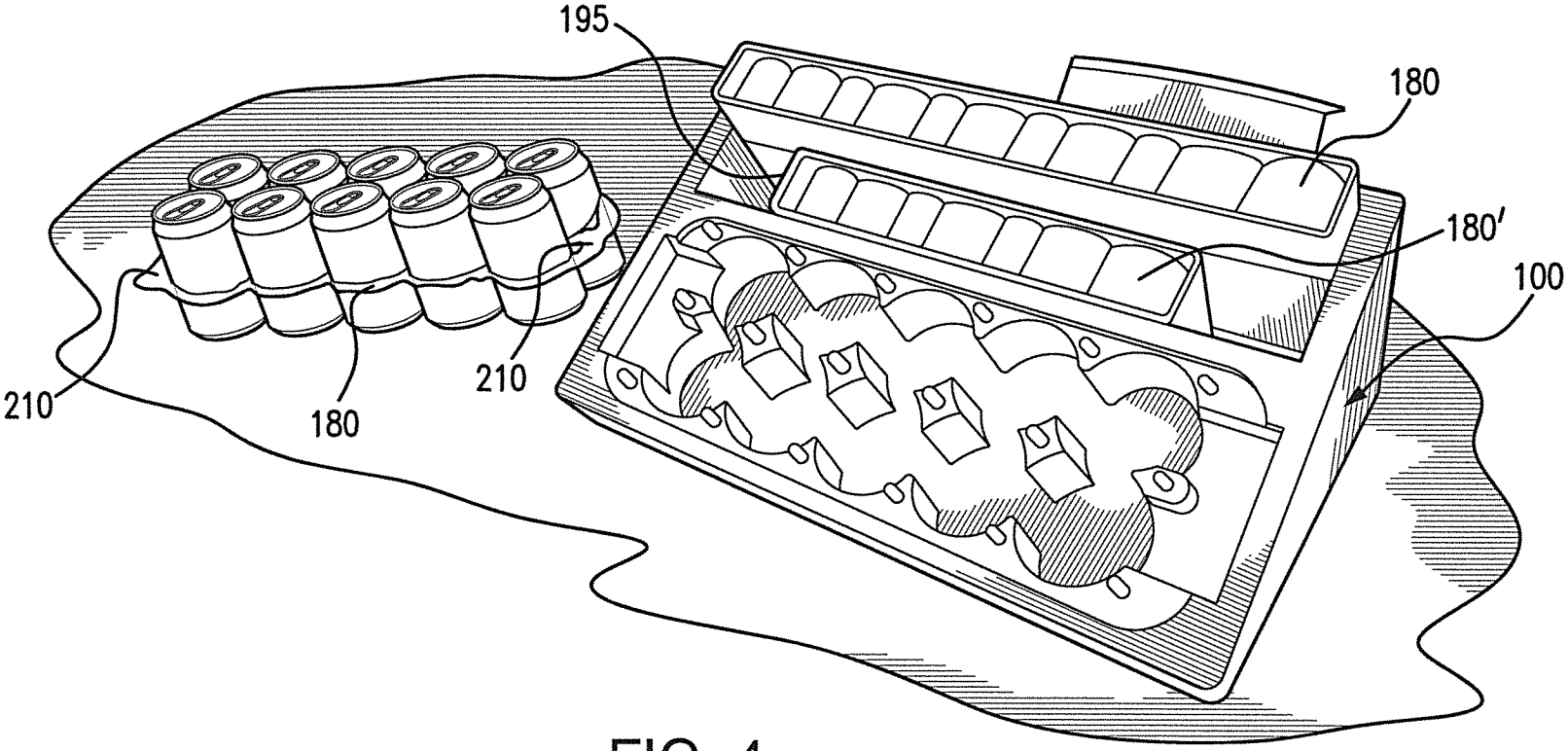
FIG. 4 is a side perspective view of a device according to one preferred embodiment of this invention.
Figure 5:
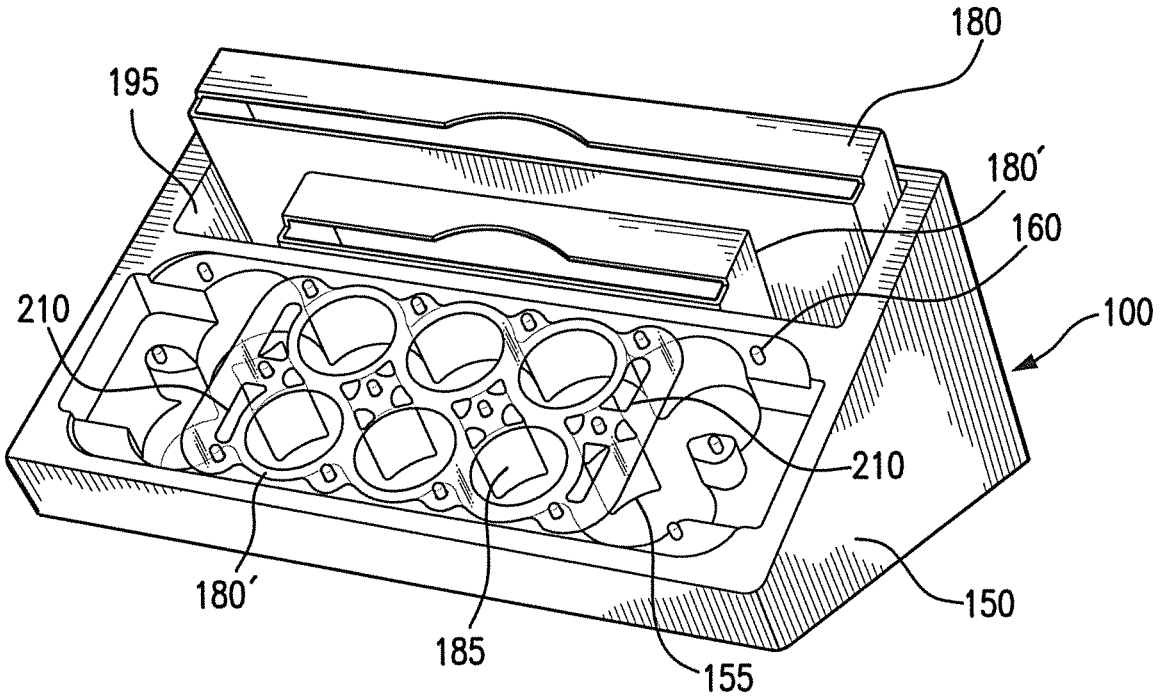
FIG. 5 is a side perspective view of a device according to one preferred embodiment of this invention.
Figure 6:
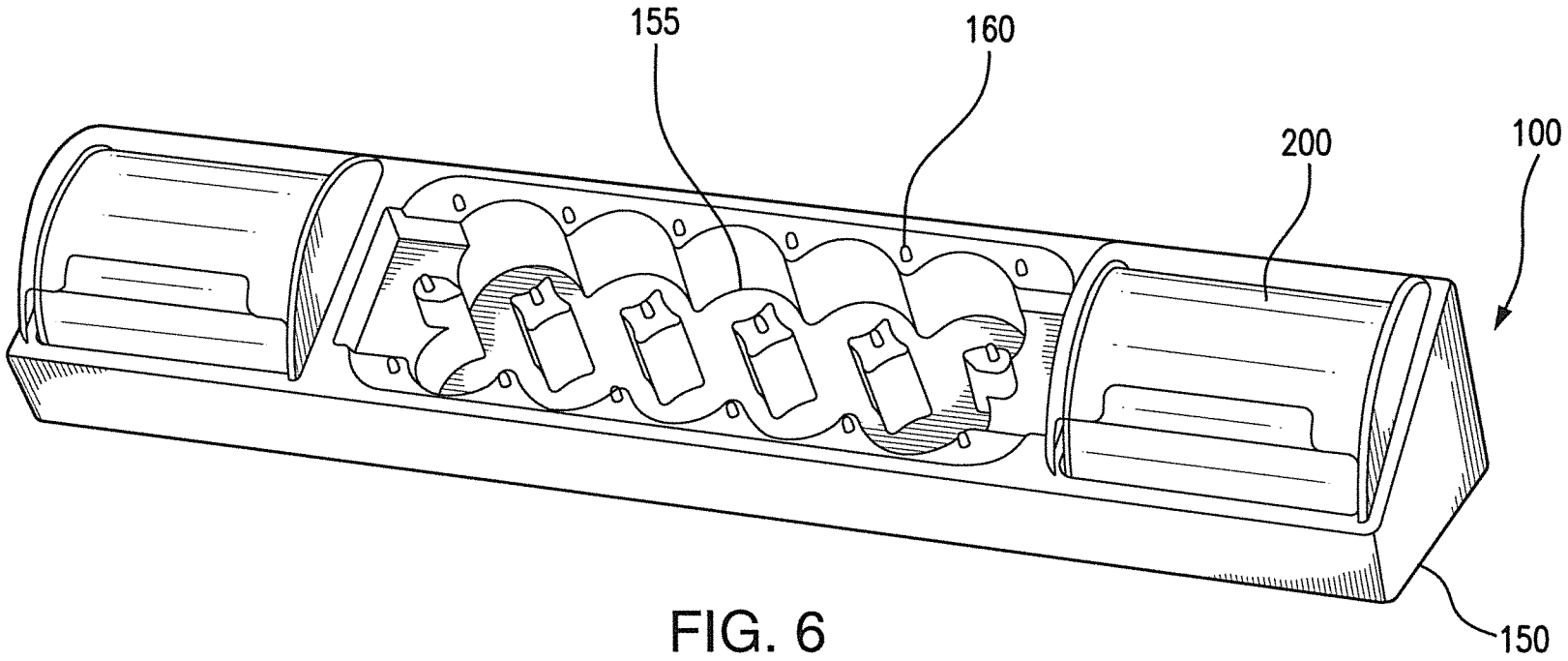
FIG. 6 is a side perspective view of a carrier according to one preferred embodiment of this invention.

In operation, the device 10 is preferably positioned on a work surface in a retail environment, preferably in proximity to individually selectable containers. According to one preferred embodiment of this invention, the flexible carrier 80, such as shown in FIG. 2, having a plurality of apertures 85 is then loaded into the device 10 by positioning an indexing feature, such as indexing holes 90, over corresponding indexing pins 60 of the base 50 so that the flexible carrier 80 extends across the pockets 55. As shown in each embodiment herein, it may be preferable to include four indexing holes 90 for each aperture 85. In this manner, each aperture 85 is maintained in a predictable position as containers are inserted as described below. Although described herein as indexing pins 60 and indexing holes 90, the indexing means according to this invention may comprise a profile formed into the base 50 into which a carrier having a corresponding profile may be placed. Alternatively, a clamp system or similar indexing means may be utilized.

Figure 7:
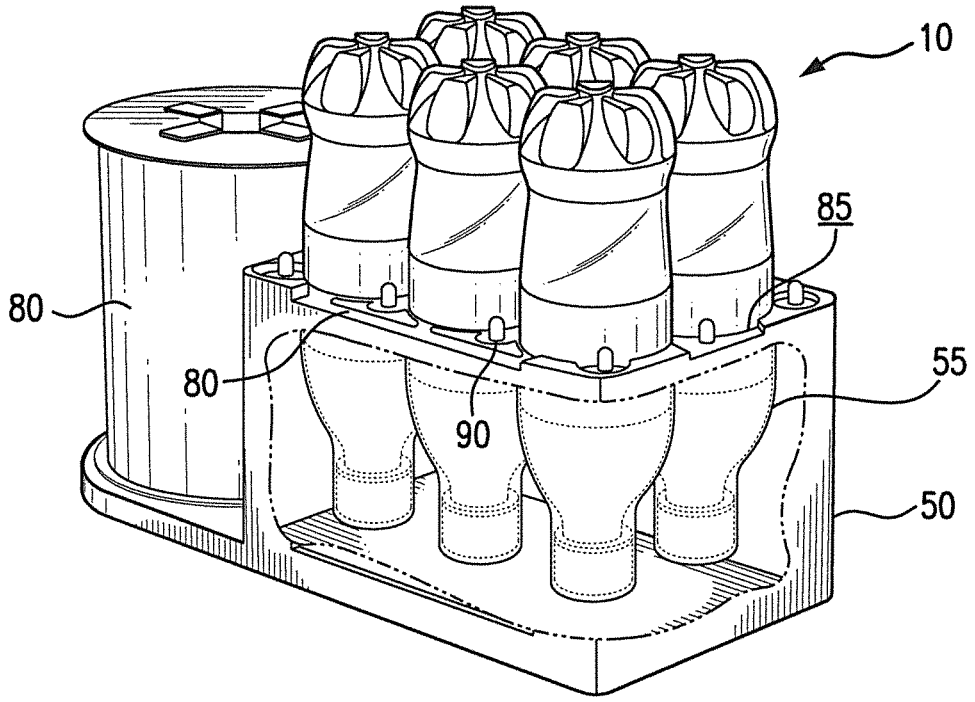
FIG. 7 is a side perspective view of a device according to one preferred embodiment of this invention.
Figure 8:
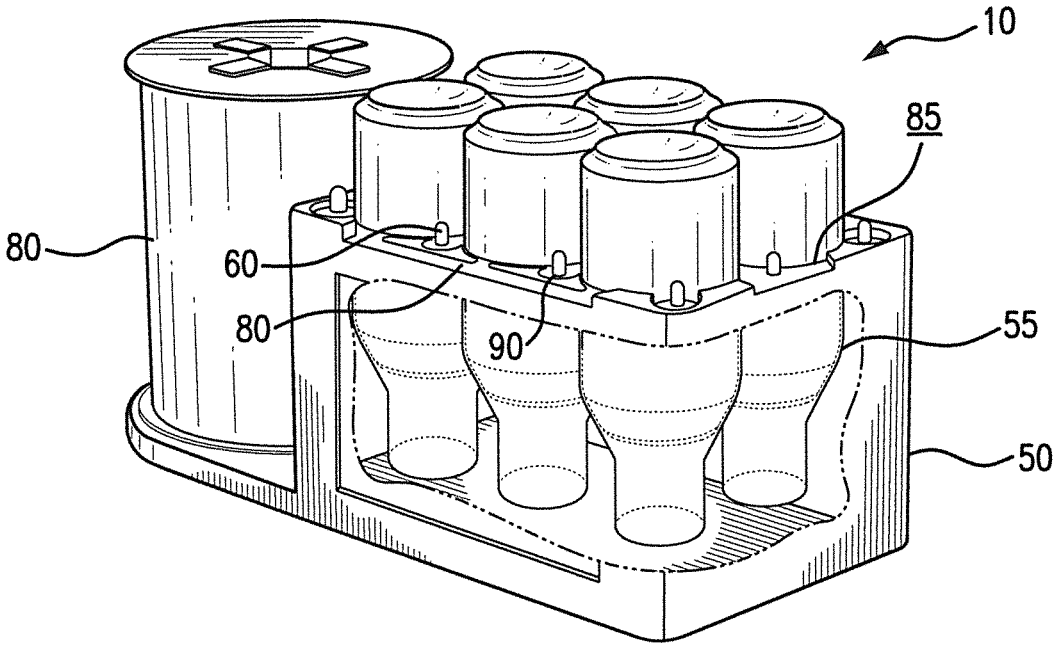
FIG. 8 is a side perspective view of a device according to one preferred embodiment of this invention.

The user then inserts the desired containers into the respective pockets 55 by pushing the container through the apertures 85 of the flexible carrier 80 until the containers are seated within the pockets 55, such as shown in FIGS. 7 and 8. The containers are preferably seated within the pockets 55 at a predetermined distance so the containers are properly positioned within the flexible carrier 80 at a desired height and with a desired stretch or tension. For instance, a depth of the pocket 55 may be approximately half a height of the container. In one preferred embodiment, the pockets 55 are contoured to result in precise placement of the containers within. More preferably, the pockets 55 are contoured to provide at least two precise stops—one stop for cans and one stop for bottles. In this manner, either cans or bottles may be inserted into the pockets 55 and still will be vertically positioned within a respective carrier 80 at a preferred height.

The embodiments described throughout this specification thereby require a user to push containers through a flexible carrier unlike typical hand applied devices that require a flexible carrier to be stretched over containers using some sort of mechanical device. In this way, the subject invention utilizes a passive applicator without moving parts that would complicate or add expense to the process. In addition, the containers themselves stretch the apertures 85 of the flexible carrier 80 not the typical reverse process whereby the flexible carrier 80 is stretched to meet the containers. The flexible carriers described throughout this specification thereby include a lower than typical stretch of 15-20%, more optimally 17%, to engage with the containers. This is much lower than traditional carriers that may stretch 25, 30 or even greater than 50% to engage around a respective container.

As shown in FIG. 7, a plurality of bottles may be inserted within the pockets 55 that may include tapered lower portions for accommodating the corresponding tapered shape of the respective bottles. Alternatively, the bottles may be inserted bottom side down and the pockets 55 may be configured in that manner.

As shown in FIG. 8, a plurality of cans may be inserted into the pockets 55. In such a configuration, it may be preferable for the pockets 55 to be configured such that the cans may be inserted right side up or upside down and thereby enable the flexible carrier 80 to be positioned at mid-height of the respective cans. As a result, the carrier will be preferably aligned halfway up the sidewall of the respective containers. In this manner, the specific vertical orientation of the can by the user will not affect the integrity of the package. The pockets 55 may be similarly configured to permit this in bottle applications such as shown in FIG. 7.

Following insertion of the containers within flexible carrier 80, the unitized plurality of containers may be removed from device 10 thereby forming a unitized package. The containers may be cans and may be inserted into the carrier 80 top side down to result in a unitized package having a desired placement of the flexible carrier 80 relative to the containers.

FIGS. 3-6 show a device 100 for unitizing a plurality of containers within a flexible carrier to form a unitized package. Although FIGS. 3-6 illustrate a multipackage having ten containers, the illustrations are exemplary, and the invention is not limited to the flexible carriers or device shown. The device 100 may be configured and used to unitize four, six eight, twelve or any other desired number of containers and/or flexible carriers. In addition, the device 100 may be configured and used to unitize multiple sets of a desired number of containers simultaneously, such as three sets of two containers or two sets of three containers.

As described above, the device 100 as described is used to unitize a plurality of appropriate containers, preferably cans or bottles. However, any other commonly unitized container may be used with the device 100 according to this invention. The containers are preferably like-sized within a single flexible carrier 80.

A multipackage results from application of the flexible carrier 180, 180' to the plurality of containers. As described above, flexible carriers 180, 180' are generally applied to such containers by stretching the flexible carrier 180, 180', specifically the material surrounding individual container apertures 185 around a perimeter of the respective container, and allowing the stretched flexible carrier 180, 180' to recover, thereby providing a tight engagement. The flexible carrier 180, 180' is typically applied to a chime or rib of the container, where this structure exists, or to a main sidewall.

As shown in FIGS. 3-6, flexible carrier 180 may comprise a carrier having ten container apertures 185 to accommodate ten containers. In addition, a flexible carrier 180' may be provided having eight container apertures 185 to accommodate eight containers. In this manner, a user may choose the number of containers for unitizing and select the desired flexible carrier 180, 180' for use. This embodiment may further include a third, fourth or further additional flexible carrier for accommodating any desired number of containers. According to this embodiment, a base having a different number of pockets 155 than container apertures in a carrier may be utilized. For instance, a base having ten pockets 155 may be used in connection with a carrier having six container apertures. This increases the flexibility of the system for the user and retailer.

According to a preferred embodiment of the invention, the device 100 for applying the flexible carrier 180, 180' to a plurality of containers 15 includes a base 150 having a series of pockets 155 and a series of indexing pins 160. In addition, the base 150 may include a carrier pocket 195 or a spindle 200 or similar mount for accommodating a reel or similar assembly of carrier 180, 180' that may be individually dispensed onto the base 150 for application to containers. A reel of carriers 180, 180' may include a generally continuous string of carriers 80 that are separable along perforations.

Similar to the device 10 described in FIGS. 1 and 2, in operation, the device 100 is preferably positioned on a work surface in a retail environment, preferably in proximity to individually selectable containers. According to one preferred embodiment of this invention, the desired flexible carrier 180, 180', having, for example, six container apertures 185 or ten container apertures 185, such as shown in FIG. 3-6, is then loaded into the device 100 by positioning indexing holes 190 over corresponding indexing pins 160 of the base 150 so that the flexible carrier 180 extends across the pockets 155.

The user then inserts the desired containers into the pockets 155 and through the apertures 185 of the flexible container 180, 180' until the containers are seated within the pockets 155. The containers are preferably seated within the pockets 155 at a predetermined distance so the containers are properly positioned within the flexible carrier 180 at a desired height and with a desired stretch or tension. Following insertion of the containers within flexible carrier 180, the unitized plurality of containers may be removed from device 100 thereby forming a unitized package.

In particular, a handle 210 may be positioned at each end of the flexible carrier 180, 180' to promote removal from the device 100 and subsequent carrying by the user. The placement of two handles 210, one at each end of the flexible carrier 180, 180' enables the user to grasp and remove the unitized package from base 100 in an even manner.

Figure 9:
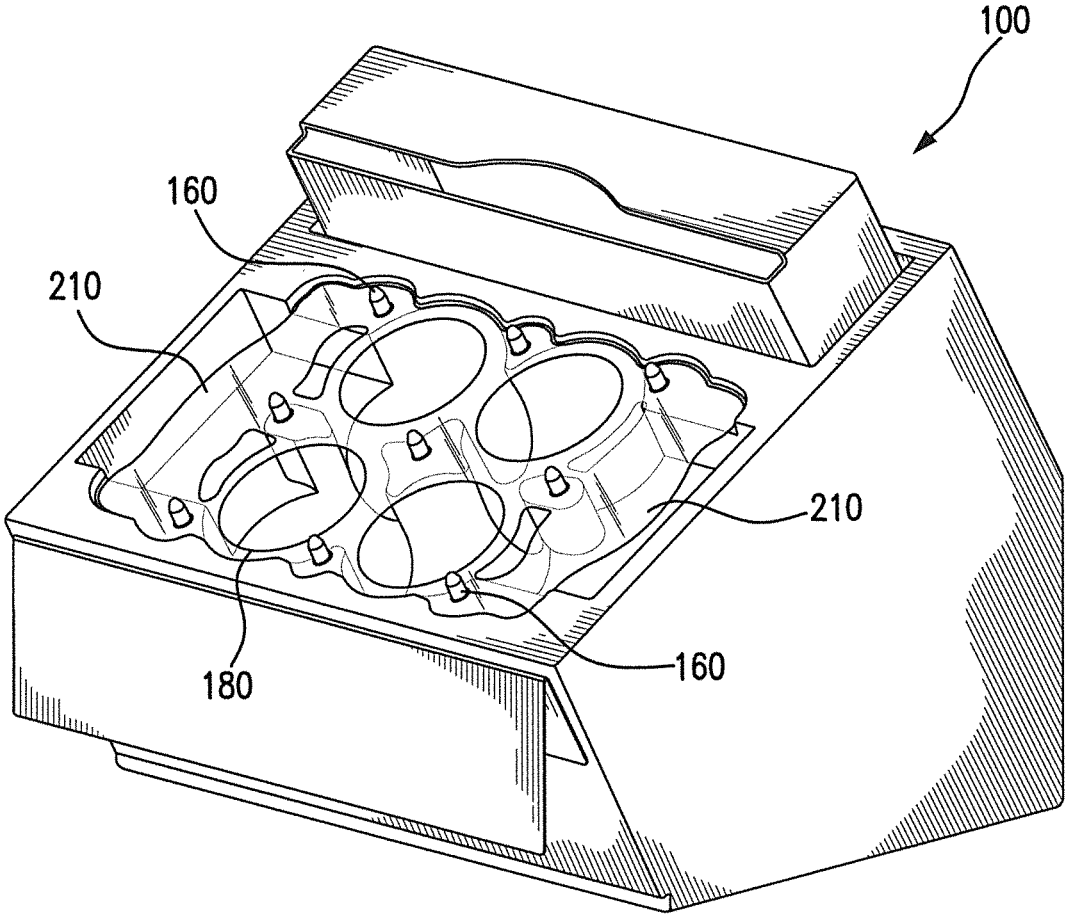
FIG. 9 is a side perspective view of a device according to one preferred embodiment of this invention.

FIG. 9 shows a device 100 for unitizing a plurality of containers within a flexible carrier to form a unitized package. Although FIG. 9 illustrates a multipackage having four containers, the illustration is exemplary, and the invention is not limited to the flexible carriers or device shown. Although the device 100 and flexible carrier 180 is similar in many ways to the device shown in FIGS. 3-6, according to this preferred embodiment, the handle 210 positioned at each end of the flexible carrier 180 is preferably asymmetric to promote both proper placement of the carrier 180 on the device 100 and to provide some form of fanciful shaped billboard along the handle 210. In this manner, the handles 210 enable a consumer to properly index the carrier 180 within the device 100. The asymmetric handles 210 may be used in addition to or in lieu of the indexing pins 160. Like the embodiments described above, the handles 210 additionally promote removal from the device 100 and subsequent carrying by the user. The placement of two handles 210, one at each end of the flexible carrier 180, enables the user to grasp and remove the unitized package from base 100 in an even manner.

While in the foregoing specification this invention has been described in relation to certain preferred embodiments thereof, and many details have been set forth for purpose of illustration, it will be apparent to those skilled in the art that device 10 is susceptible to additional embodiments and that certain of the details described herein can be varied considerably without departing from the basic principles of the invention.

The invention claimed is:

1. A device for applying a flexible carrier to a plurality of containers, the device comprising:

a base including an upper surface, a lower surface opposite the upper surface, a plurality of pockets formed in the upper surface, and an indexing means formed on the upper surface, wherein the lower surface is configured to set on a work surface and each pocket includes a contour to provide at least two stops for at least two varieties of container; and a plastic carrier having a series of indexing features that correspond to the indexing means for placement of the carrier relative to the base, wherein a container is inserted through the carrier positioned on the upper surface and into one of the plurality of pockets of the base for desired vertical alignment of the container within the carrier, and wherein the carrier stretches no more than 15-20% to engage the container.

2. The device of claim 1 wherein each pocket of the plurality of pockets includes an interior contour that matches a respective exterior contour of the container.

3. The device of claim 1 wherein each pocket of the plurality of pockets includes two or more interior contours that match respective exterior contours on at least two distinct styles of containers.

4. The device of claim 1 comprising ten pockets.

5. The device of claim 1 wherein the carrier includes two handles each comprising a handle opening in the carrier, wherein one handle is positioned at each longitudinal end of the carrier.

6. The device of claim 1 further comprising an integrated supply of carriers positioned with the base.

7. The device of claim 6 wherein the integrated supply of carriers comprises a reel of carriers placed on a spindle.

8. The device of claim 6 wherein the integrated supply of carriers comprises a carrier pocket positioned within the base.

9. The device of claim 1 wherein the indexing means comprises a series of indexing pins extending from the upper surface and the indexing features comprise a corresponding plurality of indexing apertures in the carrier.

10. The device of claim 9 wherein the carrier includes a plurality of container receiving apertures and four indexing apertures are associated with each of the container receiving apertures in the carrier.

11. The device of claim 1 wherein each pocket includes a depth at least half as deep as a height of the container.

12. A device for applying a flexible plastic carrier having a plurality of container receiving apertures for a plurality of containers, the device comprising:

a base including a top surface with a plurality of pockets corresponding to the plurality of container receiving apertures, wherein each pocket includes a depth at least half as deep as a height of the containers, wherein the base includes a bottom surface disposed opposite the top surface and configured to set on a work surface, wherein the top surface includes a plurality of indexing pins positioned proximate to the plurality of pockets, wherein the carrier has a series of indexing apertures that correspond to the indexing pins for placement of the carrier relative to the base on the top surface, wherein a container is inserted through a corresponding one of the container receiving apertures into one of the plurality of pockets of the base for desired vertical alignment of the container within the carrier, and wherein the carrier stretches no more than 15-20% to engage the container.

13. The device of claim 12 wherein the pockets each include a contour corresponding to a respective container in an upside-down configuration.

14. The device of claim 13 further comprising an additional contour corresponding to an additional container style.

15. The device of claim 12 wherein the base includes more pockets than container receiving apertures in the flexible carrier.

16. The device of claim 12 wherein each pocket includes a tapered lower portion.

17. A method for applying a flexible carrier to a plurality of containers, the method comprising:

providing a base including a plurality of pockets and an indexing means;

placing a bottom surface of the base down on a work surface;

placing a carrier on a top surface of the base, the carrier having a series of indexing apertures that correspond to the indexing means; and pushing a container through the carrier to stretch the carrier no more than 15-20% and to insert the container into a respective pocket of the plurality of pockets of the base for desired vertical alignment of the container within the carrier, wherein cans stop at one depth of the respective pocket and bottles stop at a second depth of the respective pocket.

18. The method of claim 17 wherein the container is inserted upside-down within the respective pocket.

19. The method of claim 17 further comprising:

seating each container within a respective pocket of the base so that the carrier is positioned at a desired height of the container.

20. The method of claim 17 further comprising:

removing a resulting unitized package of containers from the base.

* * * * *